US007780485B2

(12) United States Patent
Morello

(10) Patent No.: US 7,780,485 B2
(45) Date of Patent: Aug. 24, 2010

(54) ELECTRICAL CONNECTOR

(75) Inventor: John R. Morello, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/228,329

(22) Filed: Aug. 12, 2008

(65) Prior Publication Data

US 2010/0041280 A1 Feb. 18, 2010

(51) Int. Cl.
*H01R 13/514* (2006.01)

(52) U.S. Cl. ..... 439/752

(58) Field of Classification Search ..... 439/595, 439/676, 752, 140, 607
See application file for complete search history.

(56) References Cited

U.S. PATENT DOCUMENTS 5,980,318 A 11/1999 Morello et al.
7,048,584 B1 5/2006 Morello et al.
7,179,136 B1 * 2/2007 Morello ..... 439/752
7,384,309 B1 6/2008 Morello et al.
7,396,255 B2 7/2008 Morello et al.

FOREIGN PATENT DOCUMENTS

| | | |
|---|---|---|
| DE | 19710427 | 10/1998 |
| EP | 0388048 | 9/1990 |
| GB | 2024538 | 1/1980 |
| GB | 2086153 | 5/1982 |

OTHER PUBLICATIONS

EP Search Report dated Dec. 16, 2009.

* cited by examiner

*Primary Examiner*—Jean F Duverne
(74) *Attorney, Agent, or Firm*—Thomas N. Twomey

(57) ABSTRACT

An electrical connector includes a terminal and a connector body. The terminal has one or more tabs. The connector body has a cavity that is constructed and sized to receive the terminal. The connector body has one or more rails, and has one or more knobs. When the terminal is received in the cavity, the tab bears against the rail and bears against the knob.

10 Claims, 2 Drawing Sheets

ELECTRICAL CONNECTOR

FIELD OF THE INVENTION

This invention relates generally to electrical connectors, and more particularly to electrical connectors having terminals that are received in cavities of connector bodies.

BACKGROUND OF THE INVENTION

Electrical connectors are often used for joining electrical circuits, wires, and/or devices to one another or to other electrical components. In one type, a plurality of terminals is joined to a single connector body which itself defines an equal number of cavities as the number of terminals so that a single terminal can be received in a single cavity. Once received, the terminals may be secured in place, requiring a tool for removal.

SUMMARY OF THE INVENTION

One embodiment of the invention may include an electrical connector that itself may include a terminal and a connector body. The terminal has one or more tabs protruding away from a side of the terminal. The connector body has a cavity that is constructed and sized to receive the terminal. The connector body has one or more rails protruding into the cavity and has one or more knobs protruding into the cavity at a position that is near the rail. When the terminal is received and temporarily secured in the cavity, the tab bears against the rail to help prevent the terminal from being inadvertently withdrawn out of the cavity. Also, the tab bears against the knob to help prevent the terminal from being moved in a forward axial direction within the cavity.

One embodiment of the invention may include an electrical connector that itself may include a male terminal and a connector body. The male terminal has a first tab that protrudes from one side of the male terminal, and has a second tab that protrudes from an opposite side of the male terminal. The connector body defines a cavity that is constructed and sized to receive the male terminal. The connector body has a first rail that protrudes into the cavity and has a second rail that protrudes into the cavity at a position that is opposite the position of the first rail. The connector body also has a first knob that protrudes into the cavity at a position that is near the first rail and has a second knob that protrudes into the cavity at a position that is near the second rail. When the male terminal is being inserted in the cavity, the male terminal is being advanced in a generally forward axial direction so that the first tab travels past the first rail and the second tab travels past the second rail. The male terminal is then reversed in a generally rearward axial direction so that the first tab travels past the first knob and the second tab travels past the second knob.

DETAILED DESCRIPTION OF THE PREFERRED EMBODIMENTS

Referring in more detail to the drawings, the figures show an exemplary embodiment of an electrical connector 10 that includes a male terminal 12 and a connector body 14. The electrical connector 10 can be used in a number of applications that join electrical circuits, wires, devices, and other electrical components, including automotive and other applications. The electrical connector 10 is designed and constructed to permit use of, among other materials, a 30% glass-fiber reinforced polybutylene terephthalate plastic (PBT 30GF) as the material for the connector body 14. The electrical connector 10 maintains a sufficient interlock between the male terminal 12 and the connector body 14 during use to minimize male terminal movement and stabilize the male terminal.

Figure 1:
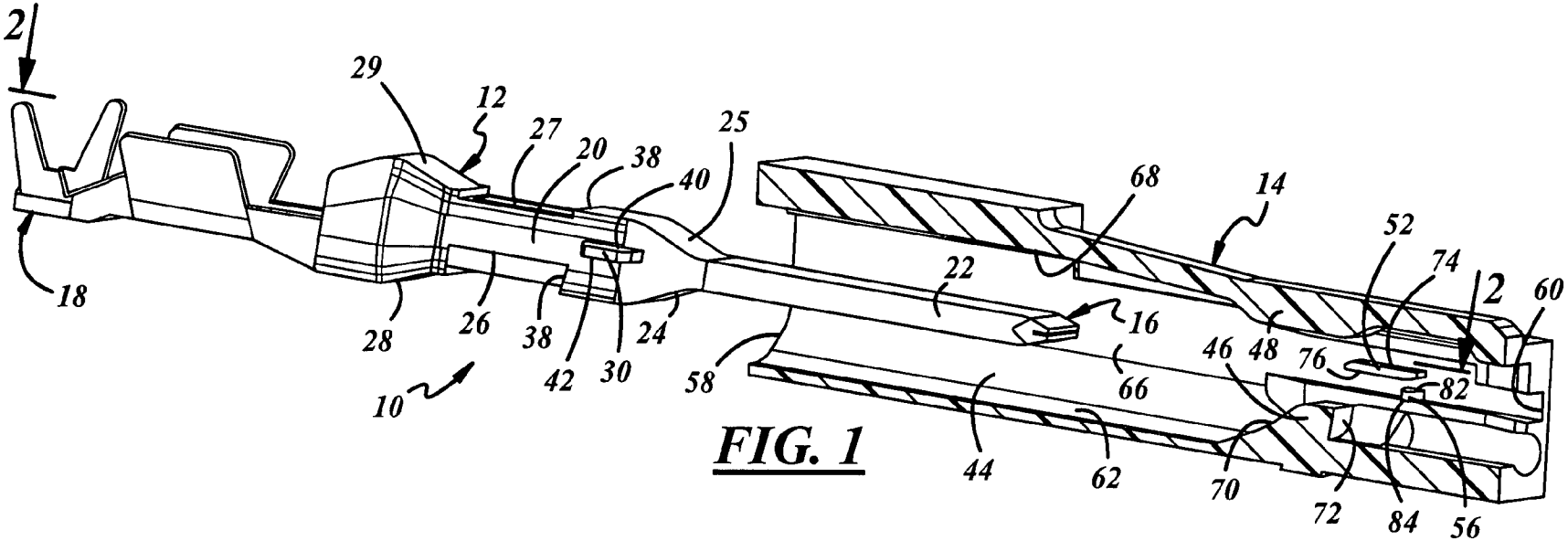
FIG. 1 is an exploded view of an exemplary embodiment of an electrical connector having a male terminal being inserted in a cavity of a connector body.
Figure 2:
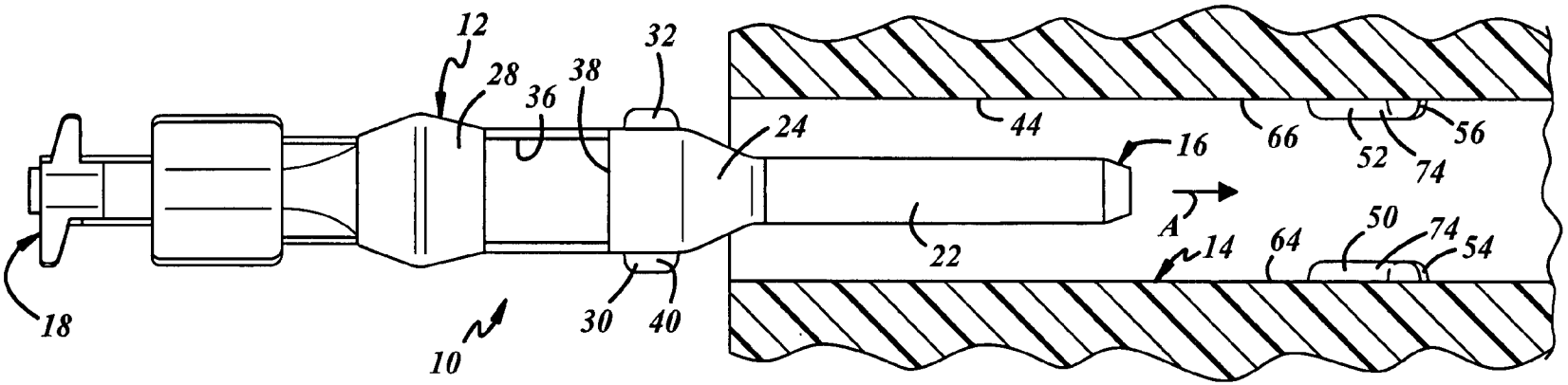
FIG. 2 is a top view of the electrical connector taken along line 2-2 of FIG. 1.

The male terminal 12 is constructed to mate with a complementary female terminal (not shown) at a first end 16, and to attach to one or more wires (also not shown) at a second end 18. Referring to FIGS. 1 and 2, the male terminal 12 has an elongated, generally hollow body portion 20 that can be generally rectangular in shape as shown, or can be generally cylindrically shaped. The male terminal 12 may also include, among other components, a blade 22, a first sloped surface 24, a second sloped surface 25, a first recess 26, a second recess 27, a third sloped surface 28, a fourth sloped surface 29, a first tab 30, and a second tab 32. The blade 22 protrudes axially from the body portion 20 and extends out of the connector body 14 when the male terminal 12 is inserted completely therein. The blade 22 mates with the complementary female terminal. The first and second sloped surfaces 24 and 25 lead from the blade 22 and are outwardly slanted from the blade and toward the recesses. In cross-section, the first and second sloped surfaces 24 and 25 can have a linear shape as shown, or can have a circular shape.

Either the first recess 26 or the second recess 27 mates with a complementary structure of the connector body 14—depending on insertion orientation—to help keep the male terminal 12 secured in place when the female terminal is mating with the blade 22 or when subjected to pulling forces from the one or more wires during use. The recesses 26, 27 can come in various shapes and sizes, including a depressed surface in the body portion 20. The recesses 26, 27 can also have openings that lead to the hollowed-out interior of the body portion 20. Each recess can have a planar shoulder 38. The third and fourth sloped surfaces 28 and 29 are located next to the recesses 26, 27 and are outwardly slanted from the recesses and toward the second end 18. In cross-section, the third and fourth sloped surfaces 28 and 29 can have a linear shape as shown, or can have a circular shape.

The first and second tabs 30 and 32 are used to help position the male terminal 12 and the connector body 14 during insertion, and are used to help keep the male terminal secured in place once the male terminal is completely received in the connector body. The first and second tabs 30 and 32 can come in various shapes and sizes. Still referring to FIGS. 1 and 2, the first and second tabs 30 and 32 are generally rectangular projections protruding away from the body portion 20 in a radial direction with respect to the body portion. The first and second tabs 30 and 32 are located on opposite sides of the body portion 20 with respect to each other, and are located between the sloped surfaces 24, 25 and the recesses 26, 27. Each of the first and second tabs 30 and 32 has a top surface and a bottom surface; for example, the first tab 30 has a top surface 40 and has a bottom surface 42 shown best in FIG. 1. In other embodiments, the first and second tabs 30 and 32 may have a semi-circular shape, a v-shape, or another shape that projects away from the body portion 20. Still in other embodiments, there may be only a single tab, or there may be more than two tabs.

The connector body 14 can be designed to receive a single male terminal 12 or a plurality of male terminals. The connector body 14 helps temporarily secure the male terminal 12 in place once received therein so that the blade 22 can mate with the female terminal without inadvertently dislodging the male terminal from the connector body and so that pulling forces from the one or more wires do not inadvertently dislodge the male terminal. The connector body 14 may include, among other components, a cavity 44, a ramp 46, a bump 48, a first and second rail 50 and 52, and a first and second knob 54 and 56. The cavity 44 defines an elongated space and extends from a first open end 58 in which the male terminal 12 enters into, and to a second open end 60 in which the blade 22 extends out of. In the case in which the connector body 14 is designed to receive more than one male terminal 12, the connector body can have an equal number of cavities as there are male terminals, and the cavities can be arranged one-on-top of the other and/or side-by-side to form an electrical connector assembly. The cavity 44 can have a generally rectangular shape and can be bounded by a floor 62, a first side wall 64, a second side wall 66, and a ceiling 68. In other embodiments, the cavity 44 may have a cylindrical shape.

The ramp 46 mates with one of the first and second recesses 26 and 27 of the male terminal 12 to help keep the male terminal secured in place when the blade 22 is mating with the female terminal and when subjected to pulling forces from the one or more wires. In FIG. 1, the ramp 46 is received in the first recess 26. The ramp 46 also helps guide and position the male terminal 12 as it is being inserted in the cavity 44. The ramp 46 can come in various shapes and sizes to, among other things, complement the various shapes and sizes of the recesses. Referring to FIG. 1, the ramp 46 protrudes from the floor 62 and into the cavity 44. The ramp 46 is rigid so that it does not substantially flex or bend, and is one-piece with the connector body 14. The ramp 46 has a surface 70 and a planar shoulder 72.

The bump 48 helps position the first and second tabs 30 and 32 with respect to the first and second rails 50 and 52 when the male terminal 12 is being inserted in the cavity 44, and helps hold-down and keep the male terminal secured in place once the male terminal is completely received in the cavity. Still referring to FIG. 1, during insertion the bump 48 flexes slightly toward the ceiling 68 and then returns to its unflexed position in which the bump biases the male terminal 12 toward the floor 62. The bump 48 is a resilient bulge that is one-piece with the connector body 14. The bump 48 extends from the ceiling 68 and protrudes into the cavity 44 toward the floor 62.

Figure 3:
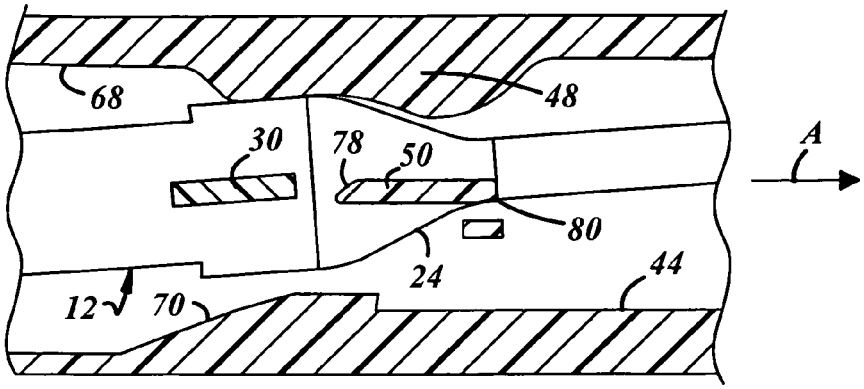
FIG. 3 is fragmented side view of the electrical connector of FIG. 1, showing the male terminal in one position as it is being inserted in the cavity.

The first and second rails 50 and 52 bear and abut against the first and second tabs 30 and 32 and are used to help hold-down and keep the male terminal 12 secured in place once the male terminal is completely received in the cavity 44. The first and second rails 50 and 52 ultimately help prevent the male terminal 12 from being inadvertently dislodged and withdrawn out of the cavity 44. The first and second rails 50 and 52 can come in various shapes and sizes. Referring to FIGS. 1-3, the first and second rails 50 and 52 each have an elongated parallelogram shape. The first rail 50 protrudes away from the first side wall 64 and into the cavity 44, and the second rail 52 protrudes at an opposite position away from the second side wall 66 and into the cavity. The first and second rails 50 and 52 are rigid so that they do not substantially bend or flex, and are one-piece with the connector body 14. Each of the first and second rails 50 and 52 has a top surface 74 and an opposite bottom surface 76. A first ramped surface 78 is formed on a forward end on each of the first and second rails 50 and 52, and a second ramped surface 80 is formed on a rearward end on each of the first and second rails. In other embodiments, there may be only a single rail, or there may be more than two rails. The exact number of rails may depend on the number of tabs.

The first and second knobs 54 and 56 bear and abut against the first and second tabs 30 and 32, and are used to help retain the tabs in place and prevent the male terminal 12 from being moved in a forward axial direction A once the male terminal is completely received in the cavity 44. Like the rails, the first and second knobs 54 and 56 ultimately help prevent the male terminal 12 from being inadvertently dislodged and withdrawn out of the cavity 44. The first and second knobs 54 and 56 can come in various shapes and sizes. Still referring to FIGS. 1-3, the first and second knobs 54 and 56 are shaped as small bulges as compared to the first and second rails 50 and 52. Of course, the knobs can have other shapes including, but not limited to, a rectangular shape or a v-shape. The first knob 54 protrudes away from the first side wall 64 and into the cavity 44, and the second knob 56 protrudes away from the second side wall 66 and into the cavity. The first knob 54 is located adjacent and below the first rail 50, and the second knob 56 is located adjacent and below the second rail 52. The first and second knobs 54 and 56 are rigid so that they do not substantially bend or flex, and are one-piece with the connector body 14. Each of the first and second knobs 54 and 56 has a top surface 82 and an opposite bottom surface 84. In other embodiments, there may be only a single knob, or there may be more than two knobs. The exact number of knobs may depend on the number of rails.

Figure 4:
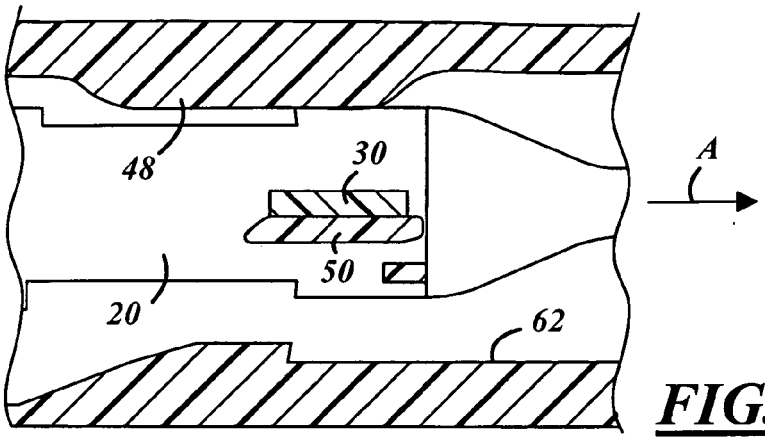
FIG. 4 is a fragmented side view of the electrical connector of FIG. 1, showing the male terminal in another position as it is being inserted in the cavity.

In use, the male terminal 12 can be temporarily secured in place in the connector body 14 by a push-pull movement. Referring to FIG. 3, the male terminal 12 is inserted into the cavity 44 and is pushed, or advanced, in the forward axial direction A. The first sloped surface 24 rides up against the surface 70 of the ramp 46 which causes the first and second tabs 30 and 32 to move in the upward radial direction and toward the ceiling 68. The second sloped surface 25 then contacts the bump 48, which flexes the bump slightly toward the ceiling 68. The first tab 30 rides against the first ramped surface 78 of the first rail 50, and the second tab 32 rides against the first ramped surface of the second rail 52. This brings the first and second tabs 30 and 32 radially above the first and second rails 50 and 52. Referring to FIG. 4, upon further advancement, the bump 48 forces the body portion 20 in a downward radial direction and toward the floor 62 as the first and second tabs 30 and 32 move axially past the first and second rails 50 and 52 in the forward axial direction A.

Figure 5:
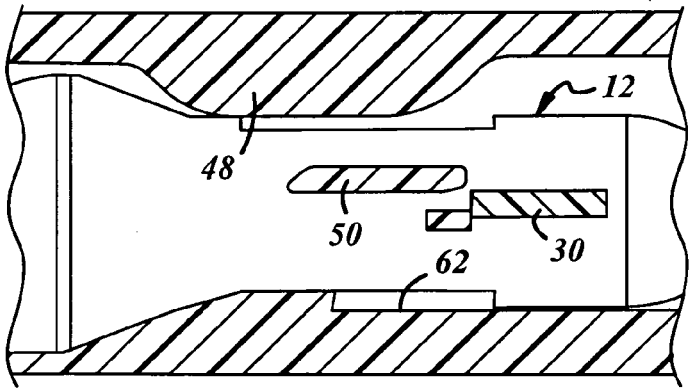
FIG. 5 is a fragmented side view of the electrical connector of FIG. 1, showing the male terminal in another position as it is being inserted in the cavity.
Figure 6:
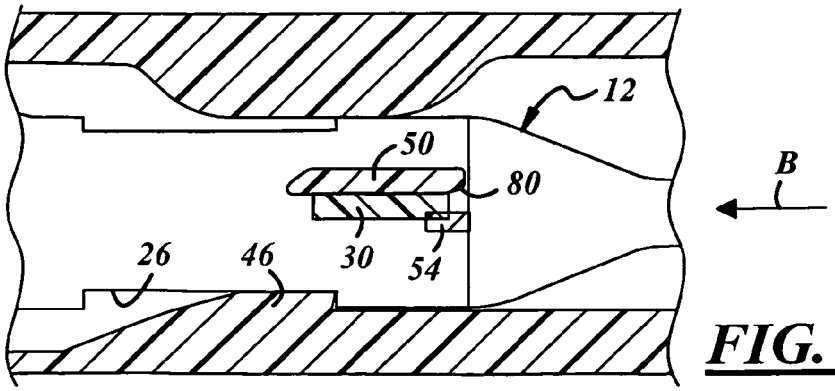
FIG. 6 is a fragmented side view of the electrical connector of FIG. 1, showing the male terminal in a final position in the cavity.

Referring to FIG. 5, the male terminal 12 continues advancement until the first and second tabs 30 and 32 travel completely axially past the first and second rails 50 and 52, whereupon the bump 48 forces the tabs toward the floor 62 and radially below the rails. Referring to FIG. 6, the male terminal 12 is then pulled and reversed in a rearward axial direction B. The first tab 30 rides against the second ramped surface 80 of the first rail 50, and the second tab 32 rides against the second ramped surface of the second rail 52. The first and second tabs 30 and 32 can respectively ride over the first and second knobs 54 and 56, or can wedge between the respective knob and rail. The male terminal 12 continues in the rearward axial direction B until the first recess 26 mates with the ramp 46, and the respective shoulders 38 and 72 abut against each other. In this final position, the first and second tabs 30 and 32 are captured beneath the first and second rails 50 and 52, and are retained thereat by the first and second knobs 54 and 56. The male terminal 12 is prevented from moving in the upward radial direction, in the forward axial direction A, and in the rearward axial direction B, all of which ultimately helps prevent the male terminal from being dislodged and unexpectedly withdrawn out of the cavity 44. The male terminal 12 is thus stabilized and the blade 22 has minimal movement. In this position too, the bump 48 can remain in contact with the male terminal 12 which can also help prevent dislodging and unexpected withdrawal.

Though the electrical connector is described as including a male terminal, it could instead include a female terminal with similar structure and functionality as described for the male terminal. For instance, the female terminal could have the tabs that interact with the rails and knobs.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

I claim:

1. An electrical connector comprising:

a terminal having a tab that protrudes from a side of the terminal; and a connector body having a cavity that is constructed to receive the terminal, having a rail that protrudes into the cavity, and having a knob that protrudes into the cavity at a position that is adjacent the rail, wherein, when the terminal is received in the cavity, the tab bears against the rail to help prevent the terminal from being withdrawn out of the cavity, and the tab bears against the knob to help prevent the terminal from being moved in a forward axial direction within the cavity;

wherein the tab includes a first tab that protrudes from one side of the terminal and includes a second tab that protrudes from an opposite side of the terminal, wherein the rail includes a first rail that protrudes into the cavity and includes a second rail that protrudes into the cavity at a position that is opposite the first rail, wherein the knob includes a first knob that protrudes into the cavity at a position that is adjacent the first rail and includes a second knob that protrudes into the cavity at a position that is adjacent the second rail, and wherein, when the terminal is received in the cavity, the first and second tabs respectively bear against the first and second rails to help prevent the terminal from being withdrawn out of the cavity, and the first and second tabs respectively bear against the first and second knobs to help prevent the terminal from being moved in the forward axial direction within the cavity.

2. An electrical connector comprising:

a terminal having a tab that protrudes from a side of the terminal; and a connector body having a cavity that is constructed to receive the terminal, having a rail that protrudes into the cavity, and having a knob that protrudes into the cavity at a position that is adjacent the rail, wherein, when the terminal is received in the cavity, the tab bears against the rail to help prevent the terminal from being withdrawn out of the cavity, and the tab bears against the knob to help prevent the terminal from being moved in a forward axial direction within the cavity;

wherein the terminal has a sloped surface and the connector body has a ramp protruding into the cavity, wherein, when the terminal is being inserted in the cavity, the sloped surface rides against the ramp to help position the tab with respect to the rail and with respect to the knob.

3. An electrical connector comprising:

a terminal having a tab that protrudes from a side of the terminal; and a connector body having a cavity that is constructed to receive the terminal, having a rail that protrudes into the cavity, and having a knob that protrudes into the cavity at a position that is adjacent the rail, wherein, when the terminal is received in the cavity, the tab bears against the rail to help prevent the terminal from being withdrawn out of the cavity, and the tab bears against the knob to help prevent the terminal from being moved in a forward axial direction within the cavity;

wherein the terminal has a recess and the connector body has a ramp protruding into the cavity, wherein, when the terminal is received in the cavity, the ramp mates with the recess to help prevent the terminal from being moved in a rearward axial direction within the cavity.

4. An electrical connector comprising:

a terminal having a tab that protrudes from a side of the terminal; and a connector body having a cavity that is constructed to receive the terminal, having a rail that protrudes into the cavity, and having a knob that protrudes into the cavity at a position that is adjacent the rail, wherein, when the terminal is received in the cavity, the tab bears against the rail to help prevent the terminal from being withdrawn out of the cavity, and the tab bears against the knob to help prevent the terminal from being moved in a forward axial direction within the cavity;

wherein the terminal has a sloped surface and has a recess, and the connector body has a ramp protruding into the cavity and has a bump protruding into the cavity, wherein, when the terminal is being inserted in the cavity, the sloped surface contacts the ramp and the bump contacts the terminal to help position the tab with respect to the rail and with respect to the knob, and wherein, when the terminal is received in the cavity, the ramp mates with the recess to help prevent the terminal from being moved in a rearward axial direction within the cavity.

5. The electrical connector of claim 4 wherein, when the terminal is being inserted in the cavity, the terminal advances in the generally forward axial direction and the sloped surface rides against the ramp to bring the tab above the rail, and upon further advancement in the forward axial direction the bump contacts the terminal to bring the tab below the rail, and the terminal reverses in the generally rearward axial direction until the ramp mates with the recess.

6. An electrical connector comprising:

a male terminal having a first tab that protrudes from one side and having a second tab that protrudes from an opposite side; and a connector body having a cavity that is constructed to receive the male terminal, having a first rail that protrudes into the cavity, having a second rail that protrudes into the cavity at a position that is opposite the first rail, having a first knob that protrudes into the cavity at a position that is adjacent the first rail, and having a second knob that protrudes into the cavity at a position that is adjacent the second rail, wherein, when the male terminal is being inserted in the cavity, the male terminal advances in a generally forward axial direction and the first and second tabs respectively travel axially past the first and second rail, and the male terminal reverses in a generally rearward axial direction and the first and second tabs respectively travel axially past the first and second knobs.

7. The electrical connector of claim 6 wherein, when the male terminal is received in the cavity, the first and second tabs respectively bear against the first and second rails to help prevent the male terminal from being withdrawn out of the cavity, and the first and second tabs respectively bear against the first and second knobs to help prevent the male terminal from being moved in the forward axial direction within the cavity.

8. The electrical connector of claim 7 wherein the male terminal has a recess and the connector body has a ramp protruding into the cavity, wherein, when the male terminal is received in the cavity, the ramp mates with the recess to help prevent the male terminal from being moved in the rearward axial direction within the cavity.

9. The electrical connector of claim 8 wherein the male terminal has a sloped surface, and wherein, when the male terminal is being inserted in the cavity, the sloped surface rides against the ramp to help position the first and second tabs when traveling past the first and second rail.

10. The electrical connector of claim 9 wherein the connector body has a bump protruding into the cavity, and wherein, when the male terminal is being inserted in the cavity, the bump contacts the male terminal to help position the first and second tabs with respect to the first and second rails and with respect to the first and second knobs as the male terminal reverses in the generally rearward axial direction.

* * * * *